US007745982B2

(12) United States Patent
Rosenmüller et al.

(10) Patent No.: US 7,745,982 B2
(45) Date of Patent: Jun. 29, 2010

(54) LAMP SOCKET WITH IMPROVED HEAT CONDUCTION

(75) Inventors: Peter Rosenmüller, Plauen (DE); Jürgen Flechsig, Plauen (DE); Gert Müller, Plauen (DE); Andreas Trampler, Plauen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 403 days.

(21) Appl. No.: 10/596,219

(22) PCT Filed: Sep. 23, 2005

(86) PCT No.: PCT/IB2005/053153

§ 371 (c)(1),
(2), (4) Date: Jun. 25, 2007

(87) PCT Pub. No.: WO2006/038144

PCT Pub. Date: Apr. 13, 2006

(65) Prior Publication Data

US 2007/0268716 A1 Nov. 22, 2007

(30) Foreign Application Priority Data

Oct. 4, 2004 (EP) ..... 04104847

(51) Int. Cl.
*H01J 5/50* (2006.01)
*F21V 19/00* (2006.01)

(52) U.S. Cl. ..... 313/318.01; 313/318.12; 313/47; 313/25; 313/27; 362/548; 362/549; 362/647

(58) Field of Classification Search ..... 313/318; 362/519; 439/639, 642
See application file for complete search history.

(56) References Cited

U.S. PATENT DOCUMENTS

| | | | | | |
|---|---|---|---|---|---|
| 4,337,508 | A | * | 6/1982 | Moffatt | 362/294 |
| 4,565,419 | A | * | 1/1986 | Johnson et al. | 439/641 |
| 4,751,421 | A | * | 6/1988 | Braun et al. | 313/318.11 |
| 4,990,820 | A | * | 2/1991 | Suster et al. | 313/49 |
| 5,684,355 | A | | 11/1997 | Seredich et al. | |
| 5,855,430 | A | | 1/1999 | Coushaine et al. | |
| 5,921,663 | A | * | 7/1999 | Flammer | 362/294 |
| 5,957,569 | A | * | 9/1999 | Helbig et al. | 362/263 |
| 6,078,136 | A | * | 6/2000 | Sica | 313/493 |
| 6,080,019 | A | | 6/2000 | Coushaine | |
| 6,536,929 | B1 | | 3/2003 | Forgacs et al. | |
| 7,559,685 | B2 | * | 7/2009 | Rosenmuller et al. | 362/647 |
| 7,573,184 | B2 | * | 8/2009 | Ngai et al. | 313/25 |

FOREIGN PATENT DOCUMENTS

| | | | |
|---|---|---|---|
| CA | 2318850 | A1 | 8/2000 |
| DE | 10023429 | A1 | 4/2001 |

* cited by examiner

*Primary Examiner*—Sikha Roy

(57) ABSTRACT

The invention relates to a lamp socket 1 for lamps 25, in particular vehicle lamps, comprising a connection region 2 for arranging the lamps 25 on a headlamp, a light or the like, a hollow-cylindrical receiving section 3 for arranging a bulb 27 on the lamp socket 1, and a cylindrical metal sleeve 4 which is arranged in the receiving section 3. In order to provide a lamp socket 1 of simple and stable design which has high heat-resistance, it is provided that a flange 5 arranged on the metal sleeve 4 rests on protrusions 7 which project from an upper edge 6 of the receiving section 3.

9 Claims, 5 Drawing Sheets

LAMP SOCKET WITH IMPROVED HEAT CONDUCTION

The invention relates to a lamp socket for lamps, in particular vehicle lamps, comprising a connection region for arranging the lamps at a headlamp, a light or the like, a hollow-cylindrical receiving section for arranging a bulb at the lamp socket, and a cylindrical metal sleeve which is arranged in the receiving section.

Known lamps of the type mentioned above have a bulb which contains the actual light-producing element and is designed for example as a glass tube with one or more incandescent coils. In order to connect the bulb to the lamp socket, the bulb is connected to a holding device made of metal, for example a so-called intermediate ring, which is integrally connected to a flange of the metal sleeve which is arranged in the receiving section of the lamp socket, said receiving section being of a corresponding hollow-cylindrical shape. Bushings are provided in the receiving section, through which bushings the contacts projecting out of the bulb are led to the terminals arranged in the connection region, by means of which the electrical contact of the lamp is established.

A motor vehicle lamp of the abovementioned type for installation in a reflector is described in U.S. Pat. No. 5,957,569. The bulb is fixed in a metal holding part which is connected to a metal sleeve, said metal sleeve in turn being fixed on the plastic socket. Electric terminals of the lamp are provided in the connection region of the plastic lamp socket. The metal sleeve is fixed on the lamp socket, wherein protruding regions of the lamp socket are screened off from the bulb by corresponding sections of the metal sleeve.

One problem in motor vehicle lamps comprising plastic lamp sockets is the transfer of heat into the plastic, said heat being generated by the bulb. High temperatures lead to decomposition, vaporization and/or gas evolution of the plastic parts.

The increasing miniaturization of headlamp housings which has recently taken place amplifies this problem. Visible vaporization, wherein the vapors precipitate on reflector faces, adversely affects not only the optics—especially in clear glass headlamps—but also the function of the headlamp, depending on the degree of vaporization.

Use is sometimes made of special plasties with increased heat-resistance in order to solve this problem. Although this does prevent the abovementioned disadvantages, the use of said plasties is extremely expensive. The use of a plastic socket which is made just partly of a special plastic does reduce the costs, but leads to increased assembly complexity on account of a multipart design of the socket, and the latter also has a reduced mechanical stability compared to one-piece lamp sockets.

It is an object of the invention to provide a lamp socket of simple and stable design which has high heat-resistance.

The invention achieves this object by a lamp socket as claimed in claim 1 and by a lamp as claimed in claim 8. The object is moreover achieved by a motor vehicle headlamp as claimed in claim 9. Dependent claims relate to advantageous embodiments of the invention.

The lamp socket according to the invention has a connection region which is provided with electric terminals. The latter are used to arrange a lamp, produced using the lamp socket according to the invention, in a corresponding connector unit of a light, a headlamp or the like.

Arranged above the connection region is a receiving section which is designed in a hollow-cylindrical manner and is open at its upper end remote from the lamp socket, with a metal sleeve designed in a corresponding cylindrical manner being arranged in said receiving section, wherein a flange arranged on the metal sleeve rests against an upper edge of the receiving section. The terms such as "above" and "below" and "upper" and "lower" which are used to describe the relative arrangement of the components in this case relate to an upright position of the lamp socket or lamp, in which the receiving section or the bulb is arranged at the top. These references serve solely for an easier understanding and are not intended to be regarded as limiting in nature.

One characterizing feature of the lamp socket according to the invention is that that flange arranged on the metal sleeve does not rest on the entire upper edge of the receiving section but rather on protrusions which project from the upper edge. The transfer of heat from the metal sleeve to the receiving section is thus considerably reduced, at least in the region of the flange, compared to if it were to rest on the entire upper edge. The flange is in this case heated to a particularly great extent on account of the direct contact with a metal intermediate ring connected to the bulb. The invention is based on the knowledge that it is mainly the upper parts of the receiving section which are exposed to particularly high thermal loading. When it is mounted in the reflector, a lamp produced using the lamp socket according to the invention is located with these upper regions very close to or even inside the reflector housing. On account of the high temperatures present there and the poor dissipation of heat, these locations are therefore subject to particularly high effects of heat.

A bottom face which forms the lower end of the hollow-cylindrical receiving section is by contrast located outside the reflector housing of the headlamp, where much lower temperatures prevail. By virtue of the design of the lamp socket according to the invention, the transfer of heat does not take place via the upper edge of the receiving section but rather in the colder region of the bottom face of the receiving section. In order to ensure particularly good heat transfer from the metal sleeve to the lamp socket in the region of the bottom face, according to one advantageous embodiment of the invention it is provided that a base of the metal sleeve bears against the bottom face of the receiving section. This bearing, which preferably takes place over the entire surface, results in heat being transferred to the lamp socket in a manner distributed uniformly over the contact area, as a result of which in particular thermal stresses within the lamp socket are additionally prevented.

Just by virtue of the design of the lamp socket according to the invention with the flange of the metal sleeve bearing against the protrusions projecting from the upper edge, the lamp socket, and in particular the upper region of the receiving section, is exposed to heat only to an extent which does not lead to decomposition, vaporization or gas evolution.

According to one particularly advantageous embodiment of the invention, an additional reduction in the transfer of heat to the receiving section can be achieved in that the receiving section has ribs which project from an inner wall, said ribs bearing against an outer wall of the metal sleeve.

Unlike when the metal sleeve bears fully against the inner wall of the receiving section, in this case the transfer of heat from the metal sleeve to the wall region of the receiving section is additionally reduced, so that the dissipation of heat from the metal sleeve substantially takes place via the base thereof which is in contact with the bottom face. The ribs may be designed in any manner. They may be formed for example by a number of webs which run longitudinally and/or transversely with respect to the upper edge. A number of punctiform raised areas distributed over the circumference is also conceivable as an alternative. Preferably, the overall contact area of the outer wall of the metal sleeve with the inner wall of the receiving section is for example less than half the external surface area of the outer wall of the metal sleeve.

In order to fix the bulb on the flange of the metal sleeve, the bulb essentially has a metal connection element, for example an intermediate ring, which is preferably connected to the flange of the metal sleeve in a joining method. The size of the contact area between the intermediate ring and the flange of the metal sleeve has a considerable effect on the heating of the flange and thus on the transfer of heat into the upper region of the connection section.

According to one advantageous embodiment of the invention, it is provided that the flange has at least one, preferably three, contact regions for fixing an intermediate ring connected to the bulb, each of said contact regions having a cam which projects from the upper side of the flange.

The cams, which melt on during the joining operation, e.g. when resistance-welding the metal insert to the intermediate ring, ensure that a defined air gap remains between the intermediate ring and the flange of the metal sleeve in the regions next to the cams, so that the transfer of heat from the intermediate ring to the metal sleeve is greatly reduced. Moreover, the use of the cams ensures a welded join without gaps, which gaps could have a negative effect on the reliability of the connection between the intermediate ring and the metal sleeve.

In order to further reduce the transfer of heat from the intermediate ring via the metal sleeve into the upper region of the receiving section, according to a further advantageous embodiment of the invention it is provided that the upper edge has cut-outs in the region of the contact regions where the metal sleeve makes contact with the intermediate ring. These cut-outs mean that there is an increased distance from the receiving section between the contact regions, which have a high temperature on account of the direct connection to the intermediate ring, and the upper edge, so that only slight heating of the upper edge takes place. Moreover, this embodiment of the invention ensures that, when the intermediate ring is mounted on the metal sleeve, the high temperatures which occur at specific points in the contact region during the joining operation do not lead to damage to the corresponding regions of the upper edge of the receiving section.

According to one advantageous embodiment of the invention, the metal sleeve is fixed in the receiving section by means of pins which project from the bottom face of the receiving section through corresponding openings in the base of the metal sleeve. Such an embodiment of the lamp socket according to the invention ensures particularly reliable bearing of the base of the metal sleeve on the bottom face of the receiving section, as a result of which the transfer of heat from the metal sleeve into the lamp socket is additionally improved. The pins may for example be mechanically caulked or hot-riveted, in order to reliably prevent any detachment of the metal sleeve.

Besides the inventive screening of the receiving section by the flange of the metal sleeve, the use of the flange also results in pleasant optics since no plastic is visible towards the interior of the reflector on account of the flange which acts as a metal lining.

According to a further advantageous embodiment of the invention, the base of the metal sleeve is designed in such a way that it secures in position a fixing spring arranged on the bottom face. By virtue of this embodiment, the spring cannot move from its predefined position, as would in some circumstances lead to short-circuits within the lamp. The spring is in this case used to fix a lamp, produced using the lamp socket according to the invention, in a predefined position in a corresponding receiving device of a headlamp, a light or the like, wherein a region of the spring projects out of the lamp socket and comes into engagement with a corresponding V-shaped groove of the receiving device.

The invention will be further described below with reference to an example of embodiment shown in the drawings to which, however, the invention is not restricted.

Figure 7:
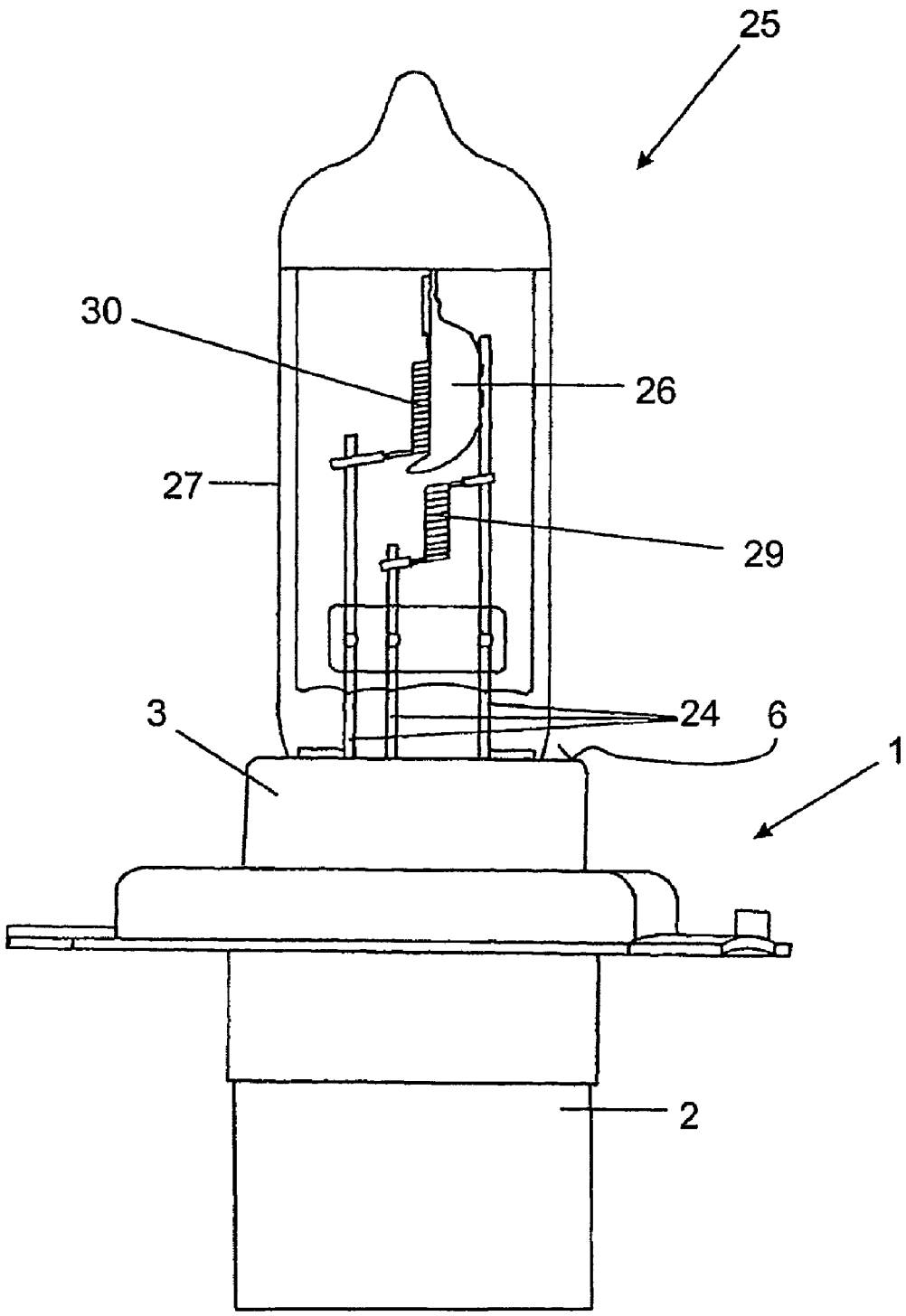
FIG. 7 shows a side view of a lamp.

FIG. 7 shows by way of example a lamp 25 which has a bulb 27 which is fixed on a lamp socket 1.

The bulb 27 is formed by a glass tube in which two incandescent coils 29, 30 are arranged, of which one incandescent coil 30 is provided with a screening hood 26.

For the electrical contacting of the incandescent coils 29, 30, the latter are connected to current carriers 24 melted into the glass tube, which current carriers project out of the bulb 27. The bulb 27 is in turn fixed on the lamp socket 1, which will be described in more detail below.

Figure 1:
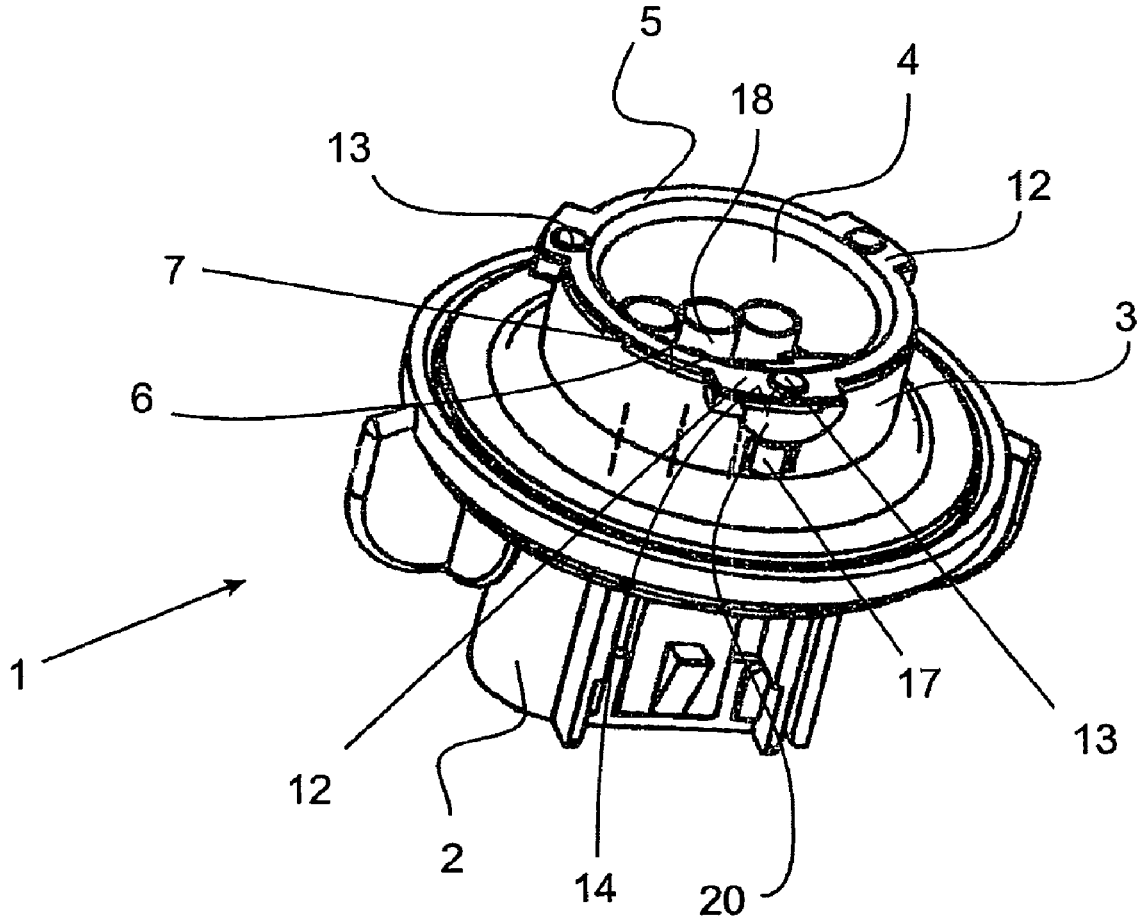
FIG. 1 shows a perspective view of a lamp socket.
Figure 2:
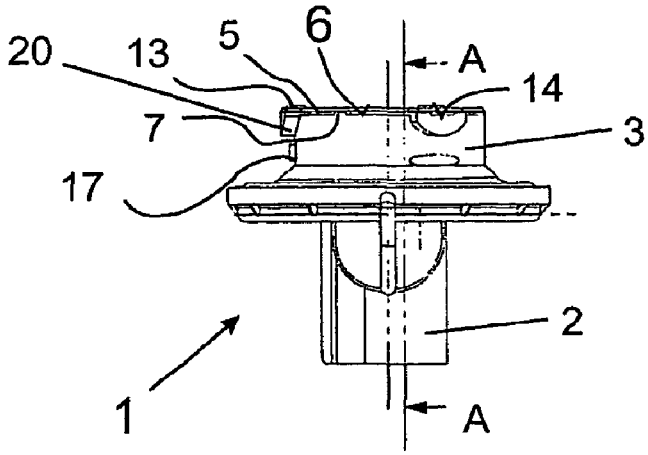
FIG. 2 shows a side view of the lamp socket of FIG. 1.
Figure 3:
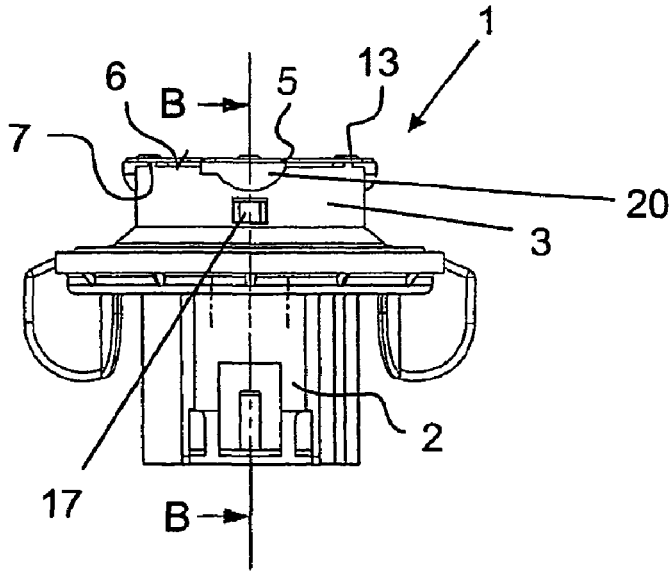
FIG. 3 shows a front view of the lamp socket of FIG. 1.

FIGS. 2 and 3 show a side view and a front view, respectively, of the lamp socket 1 shown in perspective form in FIG. 1.

The lamp socket 1 has a lower connection region 2, by means of which the lamp 25 can be fixed to a headlamp, a light or the like (not shown here). Arranged within the connection region 2, which is hollow and open towards the bottom, are three terminals 16 which are used to establish electrical contact (cf. FIG. 4).

Formed above the connection region 2 is a hollow-cylindrical receiving section 3 which has a circular cross section and is open at its upper side. Arranged within the receiving section 3 is a metal sleeve 4 which bears with its base 19 against a bottom face 8 which forms the lower side of the receiving section 3. On its upper side, the metal sleeve 4 has a peripheral flange 5 which rests on an upper edge 6 of the receiving section 3 on protrusions 7 which project from the upper edge 6, which flange screens off the upper edge 6 with respect to the bulb 27.

In the region of the upper edge 6, the receiving section 3 furthermore has support lugs 20 which project radially outwards and are arranged around the circular receiving section 3 at an angular spacing of 120° from one another. The flange 5 of the metal sleeve 4 likewise has contact regions 12 arranged around the flange 5 at spacings of 120°, which contact regions are arranged above the support lugs 20 of the receiving section 3 in the assembled state of the lamp 25.

In order to reduce the transfer of heat into the receiving section 3 both during operation of the lamp 25 and when connecting an intermediate ring (which is not shown here and bears the bulb 27) to the metal sleeve 4, for example by a joining operation, the support lugs 20 in each case have a cut-out 14 on their upper side. A clearance thus remains below the contact regions 12 of the flange 5 and the upper edge 6 of the receiving section 3.

Figure 4:
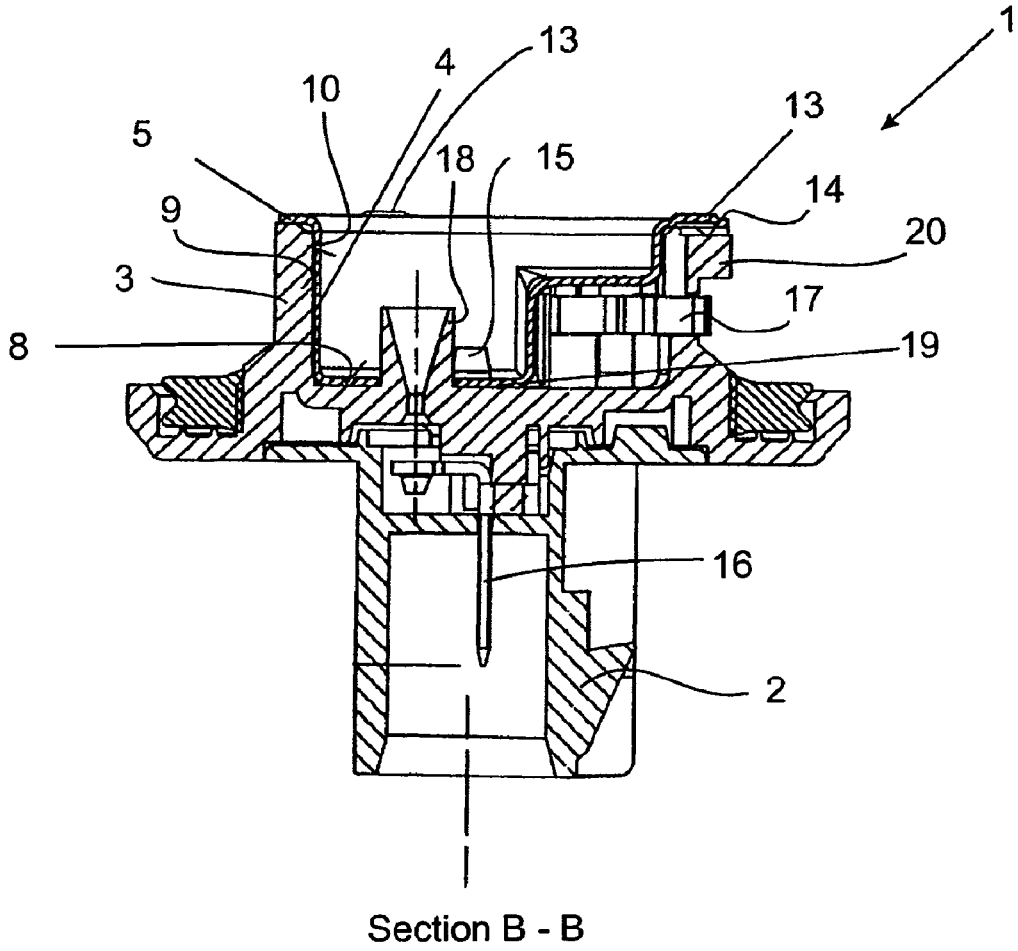
FIG. 4 shows a sectional view of the lamp socket of FIG. 1 along the section line B-B of FIG. 3.
Figure 5:
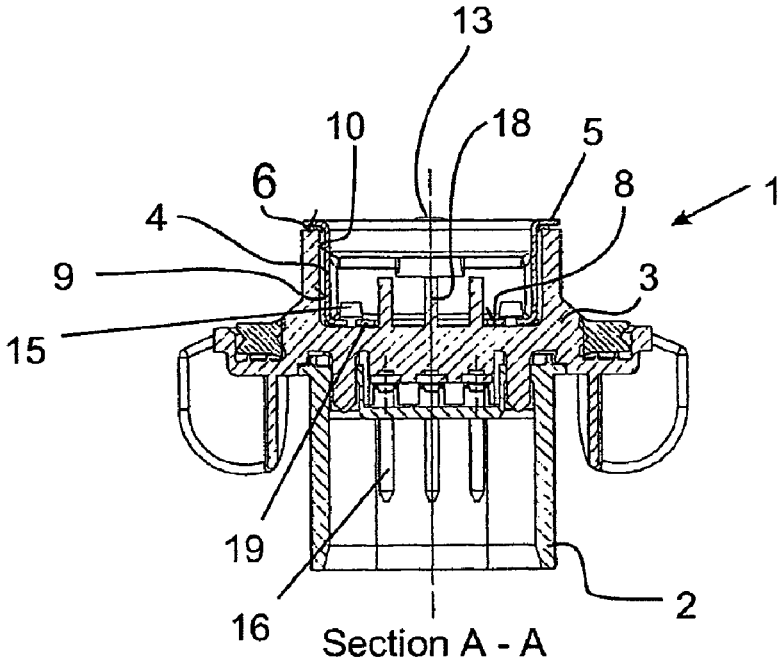
FIG. 5 shows a sectional view of the lamp socket of FIG. 1 along the section line A-A of FIG. 2.
Figure 6:
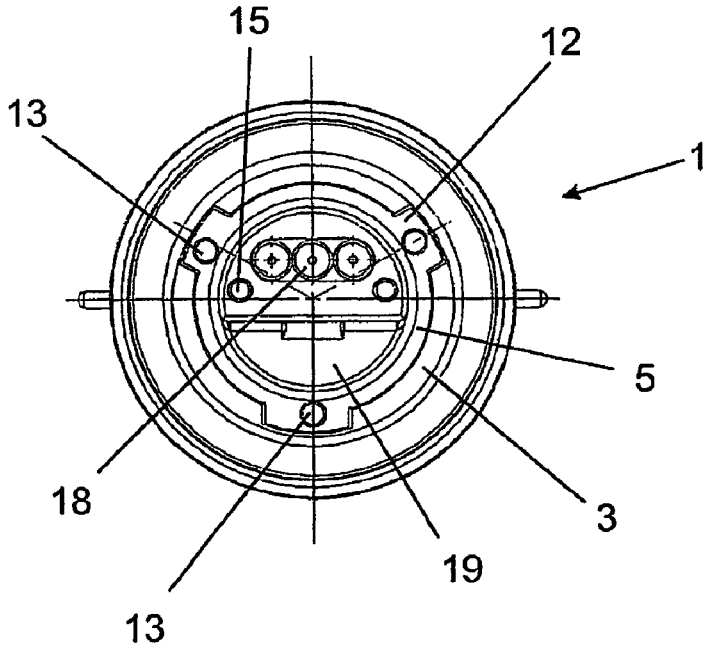
FIG. 6 shows a plan view of an upper side of the lamp socket of FIG. 1.

As can be seen from FIGS. 4 and 5, a bushing 18 projects from the bottom face 8, through the base 19, into an inner region of the metal sleeve 4. In addition, the metal sleeve 4 has on its base 19 two openings through which the plastic pins 15 project. The plastic pins 15 are melted or connected by suitable mechanical means, for example by caulking, once the metal sleeve 4 has been inserted into the receiving section 3, so that a permanent connection is produced between the metal sleeve 4 and the receiving section 3 (cf. FIG. 6).

In order to hide a spring 17 which is arranged in the region of the bottom face 8 of the receiving section 3, the base 19 of the metal sleeve 4 is designed in an appropriate manner, wherein the shape of the base 19 additionally ensures that the spring 17 remains in position on the bottom face 8 of the receiving section 3.

Cams 13 are arranged on the contact regions 12 on the upper side of the flange 5, which cams serve to securely fix the metal sleeve 4 on the intermediate ring of the bulb 27, wherein the cams 13 melt on for example by resistance-welding or laser-welding. In the rest of the region between the flange 5 and the upper edge 6 of the receiving section 3, an air gap remains so that there is a lower transfer of heat from the intermediate ring to the metal sleeve 4.

In order to further reduce the transfer of heat between the metal sleeve 4 and the upper region of the receiving section 3, the receiving section 3 has, on its inner wall 10, ribs which run perpendicular to the upper edge 6 and project from the inner wall 10, which ribs mean that an outer wall 9 of the metal sleeve 4 does not bear fully against the inner wall 10.

The invention claimed is:

1. A lamp socket for lamps, comprising a connection region, a hollow-cylindrical receiving section coupled to said connection region, a cylindrical metal sleeve which is arranged in the receiving section, and a flange arranged at the metal sleeve; wherein the flange rests on protrusions which project upwardly from an upper edge of the receiving section; and wherein the protrusions are interposed between the flange and the upper edge.

2. A lamp socket as claimed in claim 1, wherein a base of the metal sleeve bears against a bottom face of the receiving section.

3. A lamp socket as claimed in claim 1, wherein the receiving section comprises ribs projecting from an inner wall, said ribs bearing against an outer wall of the metal sleeve.

4. A lamp socket as claimed in claim 1, wherein the flange has at least one contact region for indirectly fixing a bulb, each of said contact regions having a cam projecting from the upper side of the flange.

5. A lamp socket as claimed in claim 1, wherein the upper edge defines one or more cut-outs proximate to the at least one contact region.

6. A lamp socket as claimed in claim 1, wherein the metal sleeve is fixed in the receiving section by means of pins which project from the bottom face of the receiving section through corresponding openings in the base of the metal sleeve and are riveted, preferably hot riveted, therein.

7. A lamp socket as claimed in claim 1, wherein the base of the metal sleeve is adjacent to and substantially covers a fixing spring and wherein the receiving section includes an aperture for receiving a portion of the fixing spring.

8. A lamp socket as claimed in claim 1, further comprising a bulb in said lamp socket.

9. A lamp socket as claimed in claim 8, further comprising a reflector, wherein said lamp is fitted on the reflector, wherein the bulb is arranged within a reflector housing, and the connection region of the lamp is mainly arranged outside the reflector housing.

* * * * *